US005370227A

United States Patent [19]

Shibazaki et al.

[11] Patent Number: 5,370,227

[45] Date of Patent: Dec. 6, 1994

[54] CARTRIDGE CONTAINER

[75] Inventors: Osamu Shibazaki; Toshiyuki Ikariya; Shigekazu Sakai, all of Hino, Japan

[73] Assignee: Konica Corporation, Tokyo, Japan

[21] Appl. No.: 184,726

[22] Filed: Jan. 21, 1994

[30] Foreign Application Priority Data

Jan. 25, 1993 [JP] Japan ..... 5-028687

[51] Int. Cl.[5] ..... B65D 85/672

[52] U.S. Cl. ..... 206/391; 220/501; 206/459.5; 206/497; 206/45.31; 206/508

[58] Field of Search ..... 206/391, 508; 220/501

[56] References Cited

U.S. PATENT DOCUMENTS

| | | | |
|---|---|---|---|
| 3,009,564 | 11/1961 | Geloso | 206/391 X |
| 3,516,571 | 6/1970 | Roper et al. | 206/508 X |
| 4,632,272 | 12/1986 | Berenfield et al. | 206/508 X |
| 5,064,072 | 11/1991 | Nakamura | 206/391 X |

*Primary Examiner*—William I. Price

*Attorney, Agent, or Firm*—Frishauf, Holtz, Goodman & Woodward

[57] ABSTRACT

A film cartridge container which can accommodate two film cartridges with short film tongues projecting straight from the cartridges. The film cartridge container has devices for fixing the film cartridges in the container and for attaching another film cartridge container by lid and bottom so that many containers can be stack for display.

13 Claims, 4 Drawing Sheets

CARTRIDGE CONTAINER

FIELD OF THE INVENTION

The present invention relates to a film cartridge container, and specifically relates to the cartridge container which can accommodate film cartridges, like a camera which has no back lid but has a cartridge loading opening on the bottom, under the condition that a short film tongue, projecting straight from the cylindrical surface of the cartridge in its tangential direction, is extended (not curled).

BACKGROUND OF THE INVENTION

Recently, a 135 type photographic roll film has come into popular use. The 135 type photographic roll film is accommodated in a cartridge, which is standardized by ISO (ISO/TC42), under the condition that the film is wound on a spool. The cartridge is accommodated in a plastic cartridge container with an air-tight cap which is provided in order to protect the photographic film from humidity until the cartridge is delivered to the user.

However, since the plastic cartridge container is cylindrical, and a film tongue of the cartridge accommodated in the plastic container is wound along the cylindrical surface of the cartridge, the film tongue is usually curled when the cartridge is taken out of the container. Accordingly, problems are caused in film loading depending on the camera. For example, in a camera, which has no back lid but has a cartridge loading opening on the bottom, the cartridge loading conditions are as follows: the film tongue extends straight in the tangential direction of the cartridge; and the film tongue is short. However, when the film tongue is curled as described above, the cartridge loading condition is difficult.

In the above-described camera, it is troublesome to uncurl the film by hand, and after which, the cartridge can be loaded into the camera. Further, there is a possibility that the film is not correctly loaded due to a miss loading.

Further, in the case of the conventional plastic containers, the containers have no engaging means by which the bottom surface of one container is engaged with a cap of another container, so that it is difficult to display cartridges in retail outlets when the containers are vertically stacked.

Further, because the conventional plastic container can accommodate only one cartridge, when a plurality of cartridges must be simultaneously carried, the cartridge containers require much space, which often is a problem.

SUMMARY OF THE INVENTION

In order to solve the foregoing problems, an object of the present invention is to provide a cartridge container in which: a film tongue of the cartridge is not curled so that the cartridge can sufficiently correspond to a camera which has no back lid but has a bottom cartridge loading opening; and two cartridges can be simultaneously accommodated. Another object of the present invention is to provide a cartridge container which is structured so that the cartridges are easily stacked vertically, and the cartridges are easily displayed vertically in a store. Further object of the present invention is to provide a cartridge container which is structured to prevent a film tongue from being damaged, wherein two cartridges are not lose in the container and do not interfere with each other.

In order to accomplish the foregoing objects, the present invention provides a cartridge container which is characterized in that: the cartridge container is provided with a container main body, which can accommodate two cartridges in parallel in the vertical direction, and an air-tight cover body which shields an upper opening portion of the container main body; side walls enclosing two ends, in which the cartridges are accommodated, are formed into circular arcs, and intermediate side walls are formed to be flat; and a cartridge overturning prevention means, which has predetermined gaps with respect to the flat side walls, is provided inside at the center bottom of of the container.

Further, the present invention provides a cartridge container, characterized in that: connecting means are provided which can respectively engage an outer bottom surface of one container main body with an upper surface of the cover body. Furthermore, the present invention provides a cartridge container, characterized in that: cartridge slide-contact ribs, the width of which are gradually increased towards a bottom portion, are provided near a couple of opposing border portions, which are located between circular arc side walls and flat side walls of the container main body, on a diagonal line between the two portions.

The cartridge container according to the present invention can accommodate two upright cartridges in parallel in two ends of the cartridge container. The cartridge container is provided with circular arc side walls enclosing the two ends of the container, and flat intermediate side walls, and the cartridge overturning protection means, which has predetermined gaps with respect to the flat surfaces on the intermediate portions of both ends. Accordingly, cartridges accommodated in both ends are prevented from overturning in the intermediate portion between both ends; and short film tongues, extending straight from the cartridges in the tangential direction of the cylindrical surface of the cartridges, are not hindered by the cartridge overturning prevention means, and placed along the flat surfaces of the flat side walls, so that the film tongues can not be curled. Due to the foregoing, the cartridge can be used for cameras which have no back lid but have a bottom cartridge loading opening, and cartridge loading into the camera is simplified.

Further, a connecting means, by which the outer bottom surface of the cartridge container is engaged with the upper surface of the cover body, is provided on the outer bottom surface of the cartridge container and the upper surface of the cover body. For example, a circular rib is provided along the outer periphery of the outer bottom surface of the container main body. Further, when a circular cutout portion, with which the circular rib can be engaged, is provided on the upper surface of the cover body, the cartridge containers can be vertically stacked neatly, which is advantageous in sales strategy.

Further, when cartridge slide-contact ribs, the width of which gradually increase towards the bottom, are provided near a couple of opposing border portions on a diagonal line, in the boundary portions of circular arc side walls and flat side walls of the container main body, cartridges accommodated in the corners are pushed to the intermediate separation wall (the cartridge overturning prevention means), and simultaneously pushed to the flat surface sides of the container main body.

Accordingly, the cartridges, accommodated under the condition that the film tongues are along the flat surfaces of the flat side walls, are not shaken in the container while carrying, and do not interfere with each other, so that there is no possibility that the film tongue is damaged.

DETAILED DESCRIPTION OF THE PREFERRED EMBODIMENT

Figure 1:
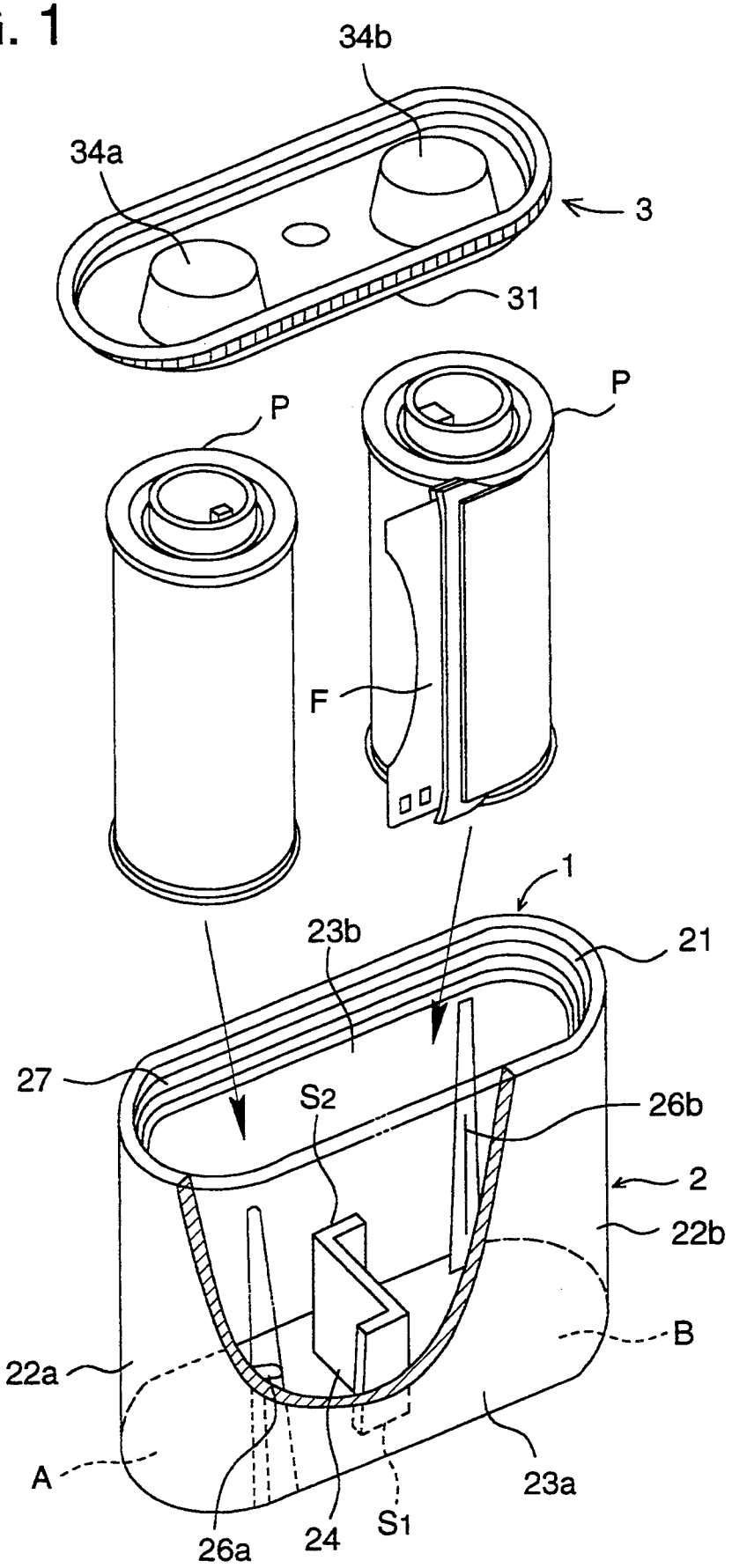
FIG. 1 is a perspective view showing an example of a cartridge container according to the present invention, and shows the relation between a container main body, which is partially cut out, and a cover body and two cartridges.

Referring to the drawings, an example of the present invention will be described as follows.

Figure 2:
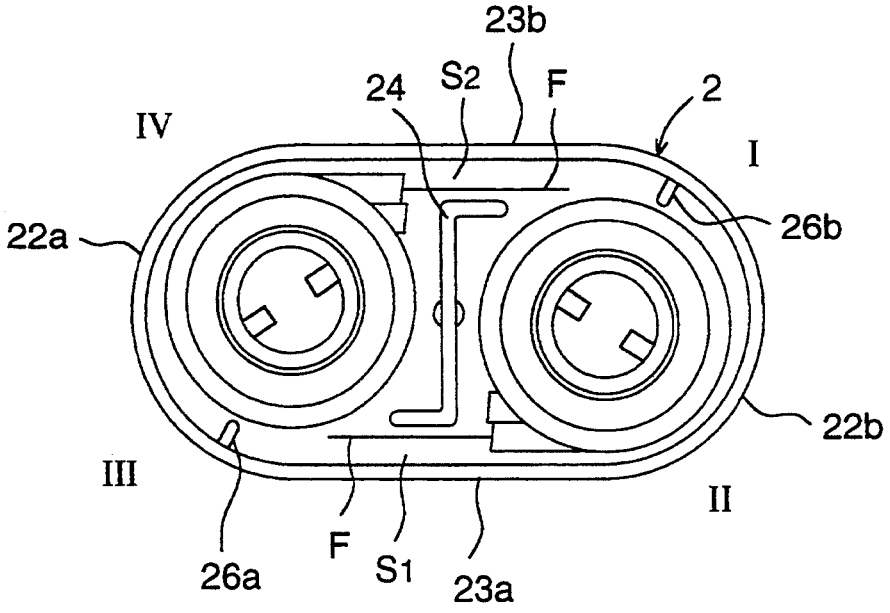
FIG. 2 is a plan view of the container main body and shows the condition in which cartridges are respectively accommodated at both ends.
Figure 3:
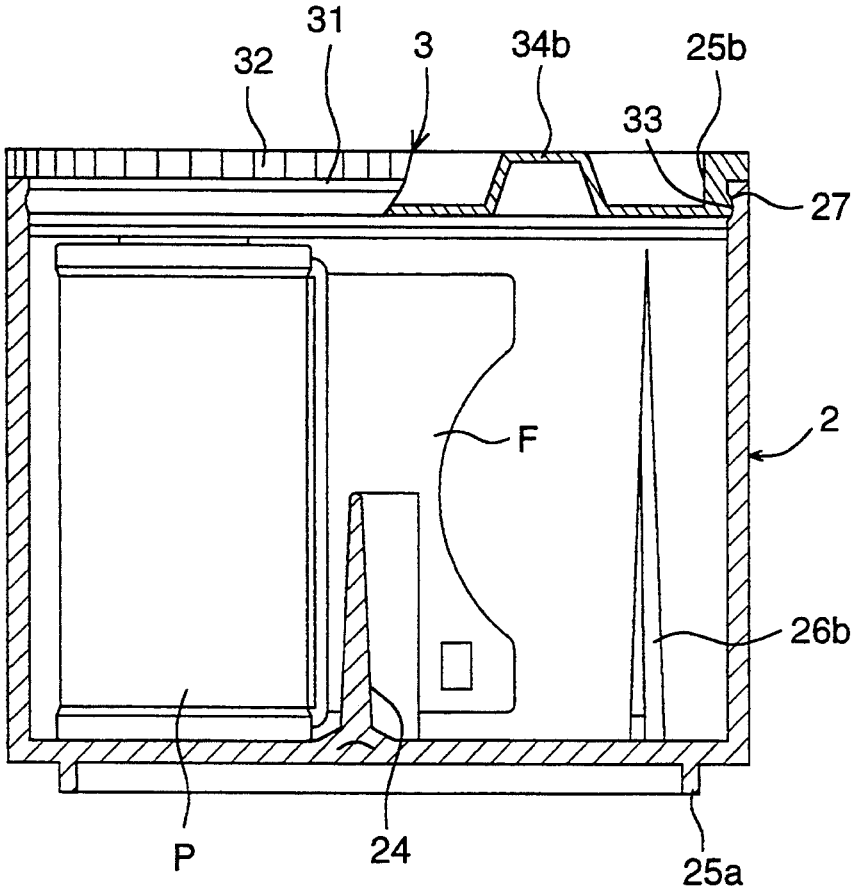
FIG. 3 is a front sectional view of the container main body, and shows the condition in which a single cartridge is accommodated at one end.
Figure 4:
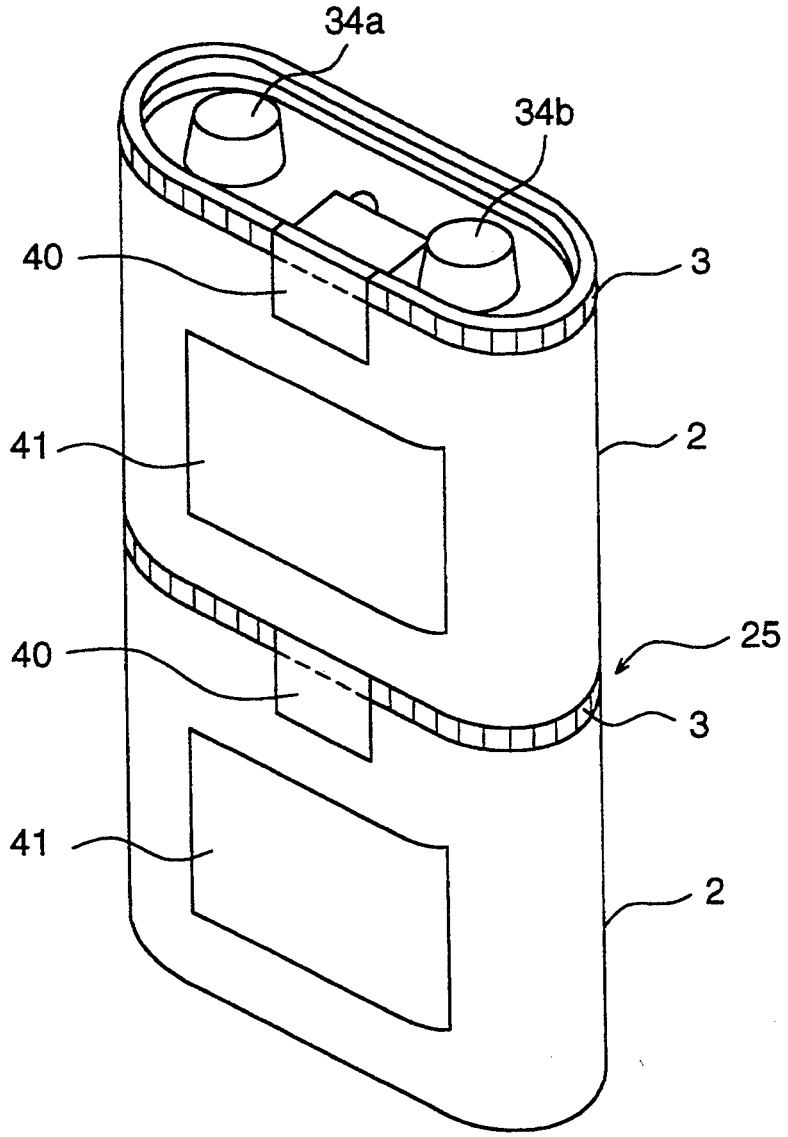
FIG. 4 is a perspective view showing the condition in which cartridge containers are stacked vertically.

FIG. 1 is a perspective view showing an example of a cartridge container 1 according to the present invention, and shows the relation between a container main body 2, which is partially cut out, and a cover body 3 and two cartridges P. FIG. 2 is a plan view of the container main body 2 and shows the condition in which cartridges are respectively accommodated at both ends. FIG. 3 is a front sectional view of the container main body 2, and shows the condition in which a cartridge is accommodated at only one end. FIG. 4 is a perspective view showing the condition in which cartridge containers 1 are vertically stacked.

The cartridge container 1 shown in FIG. 1 and FIG. 4 comprises the container main body 2, which can parallely accommodate two upright cartridges p, and the cover body 3 with an air-tight shield for an opening 21 of an upper portion of the container main body 2.

In the cartridge P, a film tongue F is extended straight in the tangential direction of the cylindrical surface $P_1$ of the cartridge P, and its length is short (an amount of protrusion; 11–17 mm). The cartridge P is adapted to a camera (not shown in the drawing), for example, which has no back lid but has a bottom cartridge loading opening. Here, in order to make the camera smaller, the cartridge having the following structure is preferable: the outer diameter of the cartridge is smaller (approximately $\phi$ 20 mm) than that ($\phi$ 25 mm) of the regular cartridge; and a hub portion of a spool shaft does not protrude as much as that of the regular cartridge (approximately the same height as a cap of the cartridge, or lower than the cap).

In the container main body 2, side walls 22*a*, 22*b* enclosing two ends A, and B, in which the cartridges P are accommodated, are formed into a circular arc (hereinafter, called circular arc side walls), and intermediate side walls 23*a*, 23*b* are formed to be flat (hereinafter, called flat side walls); and a cartridge overturning prevention means 24, which has predetermined gaps $S_1$, $S_2$ with respect to the flat side walls 23*a* and 23*b*, are provided inside at the bottom center of the container.

As shown in FIG. 1 and FIG. 2, the cartridge overturning prevention means 24 is structured as follows: both end portions of a separation wall member vertically provided from the bottom surface of the container main body 2 are formed in opposed directions respectively. Both end portions are respectively formed in opposed directions so that the cartridge overturning prevention means has the required strength. When the separation wall member is integrally molded with the container main body, the height of the separation wall member is preferably as low as possible within the range in which the separation wall member can prevent the overturning, considering the mold-release properties.

Gaps $S_1$, and $S_2$ between the cartridge overturning prevention means (separation wall) 24 and flat side walls 23*a*, 23*b* are provided so that the short film tongues F, extending straight from cartridges in the tangential directions of the cartridges, can be placed along the flat surfaces of the flat side walls 23*a* and 23*b* without being bent when the cartridges P are respectively accommodated at ends A and B.

The cover body 3 comprises an insertion portion 31 which is inserted into the opening portion of the upper portion of the container main body 2, and a collar portion 32. A circular protruded portion 33 is provided on the side surface of the insertion portion 31, and can be inserted into a mating circular groove 27 which is formed along the inner circumference of the opening of the container main body 2. That is, the cover body 3 has a function for air-tight shielding of the container main body 2, and a function for preventing the container main body 2 from separating.

Connecting means 25, by which the outer bottom surface of the cartridge container 2 is engaged with the upper surface of the cover body 3, are respectively provided on the outer bottom surface of the cartridge container 2 and the upper surface of the cover body 3. Specifically, as the connecting means 25, a circular rib 25*a* is provided along the outer periphery of the outer bottom surface of the container main body 2, and a circular cutout portion 25*b*, with which the circular rib can be engaged, is provided on the upper surface of the cover body 3. The connecting means 25 are structured so that the cartridge containers can be vertically stacked for a neat display in stores.

In this connection, in contrast with the above case, the following structure can also accomplish the object of the present invention, for the foregoing connecting means 25: a circular rib is provided on the periphery of the upper surface of the cover body 3; and a circular cutout portion is provided on the outer bottom surface of the container main body.

Cartridge slide-contact ribs 26*a*, 26*b*, the widths of which are gradually increased towards the bottom portion, are provided in the vicinity of a pair of border portions I and III, which are diagonally opposed, in the border portions I, II, III, IV between circular side walls 22*a*, 22*b*, and flat side walls 23*a*, 23*b* of the container main body 2. The cartridge slide-contact ribs 26*a*, 26*b* push the cartridges P, accommodated at ends A, B, towards the separation wall 24 (the cartridge overturning prevention means), and simultaneously push the cartridges P towards the flat surface side of the container main body 2. The widths of the cartridge slide-contact ribs 26*a*, 26*b* are gradually increased towards the bottom portion from the following reasons: when the cartridges are inserted into the container main body from the opening portion, the inserting operation can be easily conducted; and when the cartridges are settled on the bottom surface, the foregoing pushing action is conducted.

For the material of the container main body 2, PP (polypropylene) or HDPE (high density polyethylene) having the following characteristics is preferable. It is of course understood that the material of the container main body is not limited to these materials and these characteristics.

| | |
|---|---|
| Melt index | 15–30 g/10 min. |
| Density | 0.88–9.98 g/cm$^3$ |
| Flexural rigidity value | 8500–12000 kg/cm$^2$ |
| Shore hardness | 60–80 |
| Vicat softening point | 110–140° C. |

LDPE (low density polyethylene) having the following characteristics is preferable for the material of the cover body 3. Also in this case, it is of course understood that the material of the cover body 3 is not limited to the foregoing material and characteristics.

| | |
|---|---|
| Melt index | 20–50 g/10 min. |
| Density | 0.88–9.95 g/cm$^3$ |
| Shore hardness | 40–50 |
| Vicat softening point | 70–90° C. |

When cartridges P are accommodated in the container main body 2 and the container main body is shielded by the cover body 3, a seal 40 is adhered on the container main body 2 as shown in FIG. 4. This is advantageous because it can be instantly judged whether the film package has been opened.

Further, a trade mark and a label 41, on which characteristics of the accommodated photographic film are written, or a design is placed so as to increase product image, are attached on the outer surface of the flat side walls 23*a*, 23*b* of the container main body 2. Of course, printing may be done directly on the container main body 2, or the container main body 2 may be covered with a printed shrink film.

Two protruded portions 34*a*, 34*b* are provided on the circular cutout portion 25*b* on the upper surface of the cover body 3 to easily show if two cartridges P are accommodated in the shielded cartridge container.

As described above, a cartridge container according to the present invention is provided with: a container main body, which can accommodate two upright cartridges in parallel; and a cover body which can shield air-tightly an upper opening portion of the container main body, and the container main body is provided with circular arc side walls enclosing two ends, in which the cartridges are accommodated, and flat intermediate side walls, and a cartridge overturning prevention means, which has predetermined gaps with respect to the flat side walls, is provided inside at the center bottom of the container. Accordingly, cartridges accommodated at both ends are prevented from overturning in the container main body; and short film tongues, extending straight from cartridges in the tangential direction of the cylindrical surface of the cartridges, are not hindered by the cartridge overturning prevention means, and placed along the flat surfaces of the flat side walls, so that the film tongues are not curled in the container. Accordingly, the cartridge container has a specific advantage in that it can be used in the cameras which have no back lid but have a bottom cartridge loading opening, which is an excellent effect of the present invention.

An object of the present invention is to provide a cartridge container in which a film tongue is not curled and two cartridges can be accommodated.

The cartridge container according to the present invention is characterized in that: a cartridge container is provided with a container main body 2 which can accommodate two upright cartridges P, P in parallel, and a cover body 3 which can shield air-tightly an upper opening portion 21 of the container main body 2; the container main body 2 is provided with circular arc side walls 22*a*, 22*b* enclosing two ends A, B, in which the cartridges P are accommodated, and flat intermediate side walls 23*a*, 23*b*; and a cartridge overturning prevention means 24, which has predetermined gaps $S_1$, $S_2$ with respect to the flat side walls 23*a*, 23*b*, is provided inside at the center bottom of the container.

EXPLANATION OF SYMBOLS

1. A cartridge container
2. A container main body
21. An upper opening portion
22*a*. A circular arc side wall
22*b*. A circular arc side wall
23*a*. A flat side wall (an intermediate side wall)
23*b*. A flat side wall (an intermediate side wall)
24. A cartridge overturning prevention means (a separation wall)
25. A connecting means
25*a*. A circular rib
25*b*. A circular cutout portion
26*a*. A cartridge slide-contact rib
26*b*. A cartridge slide-contact rib
27. A circular groove
3. A cover body
31. An insertion portion
32. A collar portion
33. A protruded portion
40. A seal
41. A label
P. A cartridge
F. A film tongue
A. An end of the container
B. An end of the container
$S_1$. A gap
$S_2$. A gap

What is claimed is:

1. A cartridge container for accommodating two upright cartridges in parallel, comprising:
a container main body; and
a cover body;
said container main body including:
two circular arc side walls,
two flat intermediate side walls,
a bottom plate, and
cartridge overturning protection means for preventing a cartridge received in the container from overturning, said cartridge overturning protection means being provided on a center portion of the bottom plate with predetermined gaps between an inner surface of the two flat intermediate side walls and the cartridge overturning protection means.

2. The container of claim 1, further comprising:
a plurality of slide-contact tapered ribs for guiding the cartridges, the tapered ribs being provided in the vicinity of where inner surfaces of the circular arc side walls and the flat intermediate side walls are connected, and wherein:

widths of the tapered ribs gradually increase towards the bottom plate.

3. The container of claim 1 further comprising:

connecting means for enabling an outer surface of the bottom plate to engage with an outer surface of the cover body.

4. The container of claim 3 wherein the connecting means comprises:

a protruded pattern on the outer surface of the bottom plate; and an indexed pattern on an outer surface of the cover body which mates with the protruded pattern on the outer surface of the bottom plate.

5. The container of claim 3 wherein the connecting means comprises:

an indexed pattern on the outer surface of the bottom plate; and a protruded pattern on the outer surface of the cover body which mates with the indexed pattern on the outer surface of the bottom plate.

6. The container of the claim 1 wherein:

the container main body is made of polypropylene.

7. The container of claim 1 wherein:

the cover body is made of low density polyethylene.

8. The container of claim 1 wherein:

the predetermined gaps are wide enough to pass and hold two curled film tongues extending out of two cartridges in a straightened state.

9. A cartridge container for accommodating two upright cartridges in parallel, comprising:

a container main body; and a cover body;

said container main body including:

two circular arc side walls, two flat intermediate side walls, a bottom plate, and cartridge overturning protection means for preventing a cartridge received in the container from overturning, said cartridge overturning protection means being provided on a center portion of the bottom plate with predetermined gaps between an inner surface of the two flat intermediate side walls and the cartridge overturning protection means;

connecting means for enabling an outer surface of the bottom plate to engage with an outer surface of the cover body; and a plurality of slide-contact tapered ribs for guiding the cartridges, the tapered ribs being provided in the vicinity of where inner surfaces of the circular arc side walls and the flat intermediate side walls are connected; and wherein:

widths of the tapered ribs increase towards the bottom plate.

10. The container of claim 9 wherein:

the container main body is made of polypropylene having:

a melt index of 15 to 30 g/10 min, a density of 0.88 to 9.98 g/cm3, a flexural rigidity value of 8500 to 12000 kg/cm$^2$, a shore hardness of 60 to 80, and a vicat softening point of 110° to 140° C.; and the cover body is made of low density polyethylene having:

a melt index of 20 to 50 g/10 min, a density of 0.88 to 9.95 g/cm3, a shore hardness of 40 to 50, and a vicat softening point of 70° to 90° C.

11. The container of claim 9 wherein the container main body is made of high density polyethylene having:

a melt index of 15 to 30 g/10 min, a density of 0.88 to 9.98 g/cm3, a flexural rigidity value of 8500 to 12000 kg/cm$^2$, a shore hardness of 60 to 80, and a vicat softening point of 110° to 140° C.; and the cover body is made of low density polyethylene having:

a melt index of 20 to 50 g/10 min, a density of 0.88 to 9.95 g/cm3, a shore hardness of 40 to 50, and a vicat softening point of 70° to 90° C.

12. The container of the claim 1 wherein:

the container main body is made of high density polyethylene.

13. The container of claim 12 wherein:

the cover body is made of low density polyethylene.

* * * * *